US005535556A

United States Patent [19]

Hughes, Jr.

[11] Patent Number: 5,535,556

[45] Date of Patent: Jul. 16, 1996

[54] BASEMENT WALL CONSTRUCTION

[76] Inventor: John P. Hughes, Jr., 34053 Brittany Dr., Farmington Hills, Mich. 48335

[21] Appl. No.: 228,741

[22] Filed: Apr. 18, 1994

[51] Int. Cl.[6] ..... E02D 27/00

[52] U.S. Cl. ..... 52/169.5; 52/299; 52/293.3; 52/169.14; 405/229; 405/45

[58] Field of Search ..... 52/169.5, 169.11, 52/169.16, 265, 274, 293.3, 293.1, 236.6, 299, 243, 309.9, 404.1; 405/45, 43, 229

[56] References Cited

U.S. PATENT DOCUMENTS

| | | | |
|---|---|---|---|
| 1,858,701 | 5/1932 | Boeltcher | 52/293.3 X |
| 2,104,869 | 1/1938 | Levy | 52/274 |
| 3,017,722 | 1/1962 | Smith | 52/293.1 X |
| 3,188,773 | 6/1965 | Schneller et al. | 52/243 X |
| 4,078,347 | 3/1978 | Eastman et al. | 52/169.5 |
| 4,222,208 | 9/1980 | Fever | 52/299 X |
| 4,478,018 | 10/1984 | Holand | 52/404.1 X |
| 4,525,960 | 7/1985 | Kelman | 52/169.14 |
| 4,757,651 | 7/1988 | Crites | 52/299 X |
| 5,120,162 | 6/1992 | Parker | 52/169.5 X |
| 5,345,738 | 9/1994 | Dimakis | 52/309.9 |
| 5,399,050 | 3/1995 | Jacobus | 52/169.5 X |

FOREIGN PATENT DOCUMENTS

| | | |
|---|---|---|
| 1015919 | 8/1977 | Canada . |
| 0541733 | 12/1941 | United Kingdom . |

*Primary Examiner*—Carl D. Friedman
*Assistant Examiner*—Winnie Yip
*Attorney, Agent, or Firm*—Charles W. Chandler

[57] ABSTRACT

A basement wall is formed by a series of vertical metal studs supported at their lower ends on a metal sill extending along the upper face of a concrete footing. An insulating sheathing is mounted on the metal studs to form the wall outer surface. The sheathing is formed by two panel layers of rigid foam core insulator material. Edges of the inner panels are offset from the edges of the outer panels to form labyrinth seals preventing migration of ground water through the sheathing.

5 Claims, 3 Drawing Sheets

BASEMENT WALL CONSTRUCTION

BACKGROUND OF THE INVENTION

This invention relates to building construction and particularly to the construction and formation of basement walls.

PRIOR DEVELOPMENTS

Under conventional practice, basement walls are formed of concrete. Concrete is poured into the space between two vertical metal forms. Alternatively, the wall can be formed out of concrete block laid in rows to a height of about 8 or 9 feet. In either case, the wall is supported on a poured concrete footing that is somewhat wider than the wall. The concrete wall is usually about 8–10" wide, whereas the footing has a width of about 20".

One problem with concrete basement walls is their low heat insulating value. Conventional basements are relatively cool during the fall and winter months, even when heated by a furnace. As a result, the conventional basement with concrete walls is often used only for storage or for tasks that are performed sporadically, e.g. washing and drying clothes.

Another problem with conventional basement concrete walls is that it is often difficult or expensive to repair leaks caused by cracking or exterior hydraulic pressure. Such leaks can occur due to breakage or clogging of the external drain tiles that run along the outer edge of the footing.

SUMMARY OF THE INVENTION

The present invention relates to a basement wall construction having a relatively high thermal insulation value, and a reduced likelihood for developing cracks or leaks.

In a preferred form, the invention comprises a concrete footing having a channel-shaped metal sill extending along its upper face. Vertical metal studs attached to the metal sill form the support framework for the basement wall. The metal studs are spaced predetermined distances apart, e.g. on 12" centers, to form a backing or support for thermal insulation sheathing applied to the outer surfaces of the metal studs.

The thermal insulator sheathing preferably comprises two layers of thermal insulator panels, i.e. an inner panel layer positioned against the metal studs, and an outer panel layer facially engaging the inner panel layer. Each panel layer comprises a number of panels having vertical and horizontal abutting edges forming seams at spaced points along the wall. The panels are arranged so that the seams in the outer panel layer are offset from the seams in the inner panel layer, whereby the sheathing resists ground water from leaking into the basement.

DESCRIPTION OF A PREFERRED EMBODIMENT OF THE INVENTION

Figure 1:
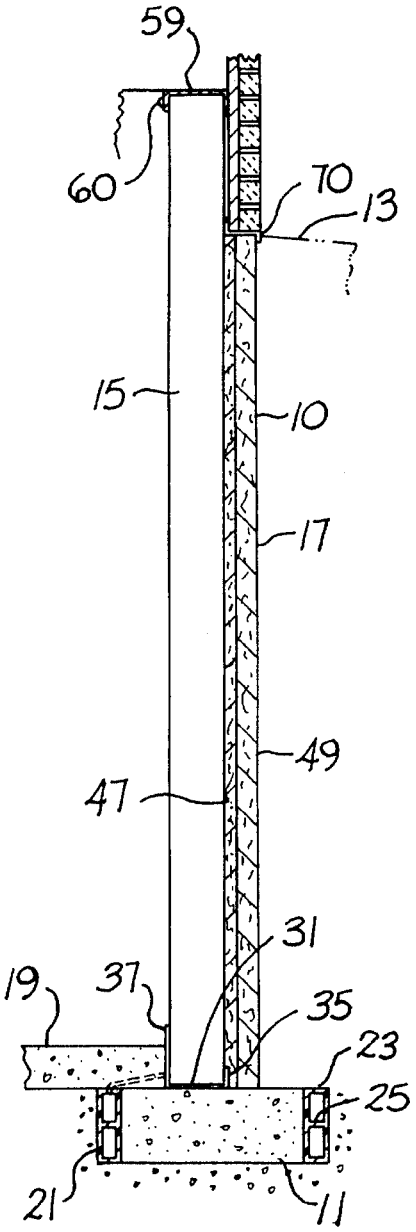
FIG. 1 is a vertical cross sectional view taken through a basement wall constructed according to the invention.
Figure 2:
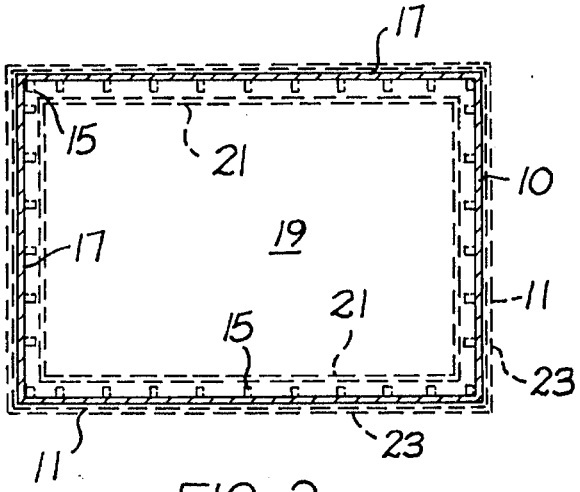
FIG. 2 is a sectional plan view, on a greatly reduced scale, through a basement having a wall construction as shown in FIG. 1.

The invention, as depicted in FIGS. 1 through 4, comprises a basement wall 10 that includes a concrete footing 11 located below ground surface 13 for supporting a series of upright metal studs or posts 15. FIG. 2 shows a representative stud arrangement for a four-sided basement framework. Rigid thermal insulation sheathing 17 is applied to the outer surfaces of upright metal studs 15 to define the basement envelope. Footing 11 partially supports a conventional poured concrete floor 19.

Figure 4:
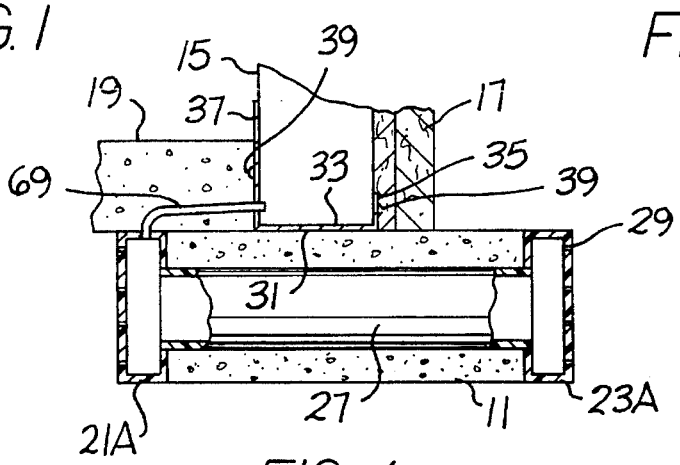
FIG. 4 is an enlarged fragmentary sectional of the footing at the coupling of a pair of drain tiles.

Referring to FIGS. 1 and 4, footing 11 has an inner edge contiguous with a hollow rigid drain tile 21, and an outer edge contiguous with an outer drain tile 23. Each drain tile comprises a rigid plastic extrusion of a box-like cross section. A partition 25 extends transversely across the midpoint of the box except at the couplings which connect the tile ends. Drain tiles 21 and 23 are used as forms for pouring the concrete footing.

The drain tiles come in twelve foot sections connected end-to-end by couplings 21A and 23A as viewed in FIG. 4 to form two annular drain channels or ducts extending around, and along, the inner and outer edges of the footing, as shown in FIG. 2. Some inner and outer drain tile couplings are rigidly connected together by a plastic bleeder tube 27 in the conventional manner. There is at least one bleeder tube 27 every 24 feet (maximum). Intermediate couplings (not shown) do not have bleeder tubes. A friction fit joins tube 27 to the drain tile couplings.

Each drain tile section can be a rigid plastic extrusion marketed by the Certainteed Corporation under the trademark "Form-A-Drain". Horizontal slits 29 are formed in the sides of the drain tiles facing away from the concrete footing to receive ground water into each drain tile. Bleeder tubes 27 act as water conduits between the inner and outer drain tiles under certain circumstances.

Either the inner drain tile system 21 or the outer drain tile system 23 is connected to a sub-surface drainage device, not shown. The drainage device can be a sump in the basement floor or a storm drain leading away from the building.

Figure 6:
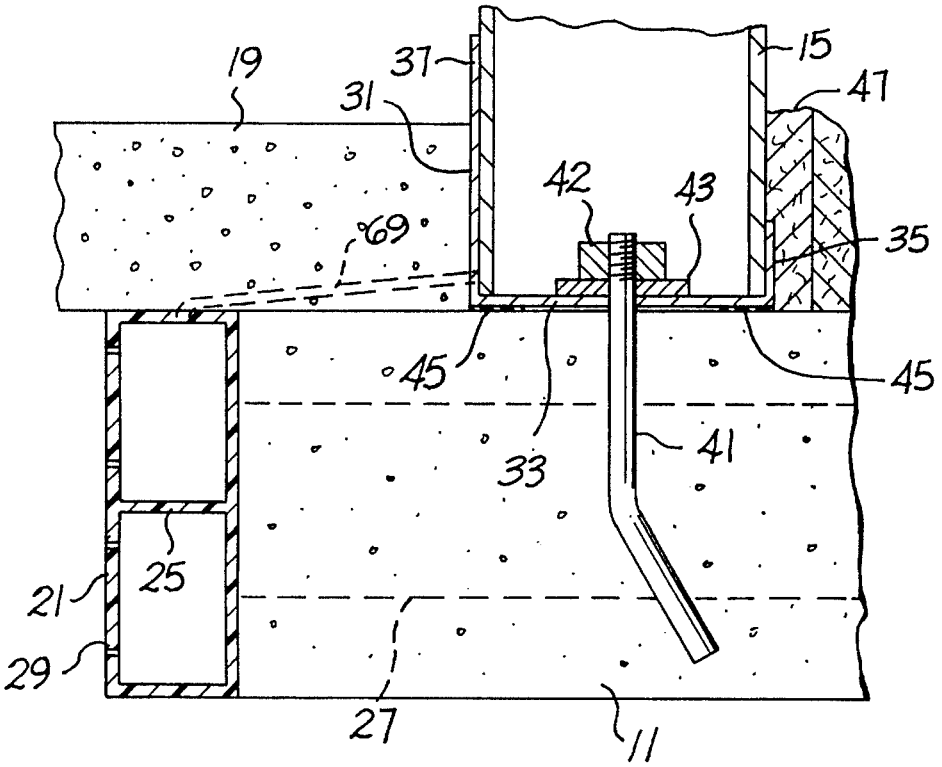
FIG. 6 is a fragmentary sectional view taken of another location along the footing.

A metal sill 31 extends along the upper face of concrete footing 11. Sill 31 could be a rigid plastic material but preferably is formed of 16 gage galvanized metal. As shown in FIGS. 1, 4 and 6, the sill has a channel-shaped cross section comprising a web 33 seated on footing 11, an outer upright flange 35, and an inner upright flange 37. Flange 37 has a height greater than the vertical thickness of concrete floor 19, forming a dam preventing water flow onto the surface of floor 19. Any water in the channel is confined to the channel.

Metal sill 31 is made up of elongated channel sections having their ends abutted together to form an endless annular channel extending around the perimeter of the building wall. Typically web 33 has a cross sectional width of about 6", flange 37 has a cross sectional height of about 6", and flange 35 has a cross sectional height of one or two inches. Concrete floor 19 typically has a thickness of about 4". The sill collects water that may pass through the wall, and is also used as a form for pouring concrete floor 19.

Figure 3:
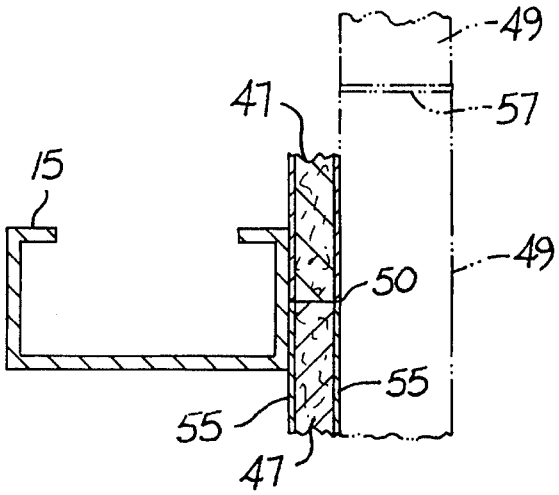
FIG. 3 is a horizontal sectional view through a typical stud.
Figure 7:
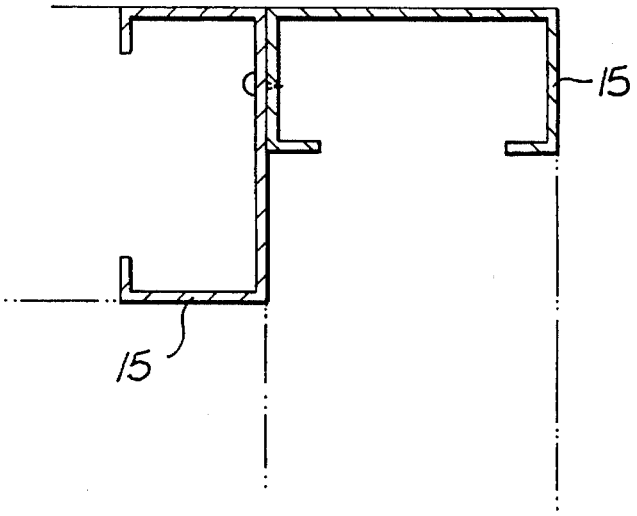
FIG. 7 is a fragmentary horizontal sectional view illustrating structural details of the steel frame at a typical corner.

Metal studs 15 each have a C-shaped cross-section, 1⅝" deep×6" wide, formed of 18 gage galvanized steel, as shown in FIGS. 3 and 7. FIG. 3 shows a metal stud located at some point between the corners of the basement, whereas FIG. 7 shows a representative metal stud located at a corner of the basement.

As shown in FIG. 6, each stud is dimensioned to fit snugly between flanges 35 and 37 of sill 31. The studs are spaced along the sill by a predetermined distance, e.g. 12". The stud spacing is related to the dimensions of the panels that form insulator sheathing 17. The studs are joined to sill 31 by self-tapping, non-corrosive, metal screws 39.

Referring to FIG. 6, anchor bolts 41 are embedded in the concrete footing at spaced points, e.g. on 12" centers, such that each anchor bolt extends upwardly through aligned holes in web 33. A nut 42 and washer 43 on each bolt clamp channel (sill) 31 to the concrete footing. The anchor bolt size depends on the load applied by the back fill soil laid against the outside sheathing surface. For illustrative purposes, the bolts are chosen with a shear strength to accommodate a 700 lb. horizontal load per lineal foot along the sill. The anchor bolts are required if the back fill soil refills the excavation before the concrete floor is laid. If the concrete floor has been laid before the excavation has been filled, then the anchoring devices may be eliminated since the floor will prevent the sill from shifting.

As an alternative to the anchor bolts, explosively drilled fastener bolts can be driven through the channel into the concrete footing.

Two beads 45 of a high grade, elastic water-proof building sealant are laid on the footing beneath each channel 31, so that when the channel is bolted to the footing, the sealant beads form sealed joints along the entire length of the channel.

Rigid thermal sheathing 17 is applied to the outer edge surfaces of metal studs 15. As shown in FIG. 1, sheathing 17 comprises inner sheathing panels 47 adhesively attached to the metal studs, and outer sheathing panels 49 laminated onto the outer faces of panels 47. Each sheathing panel 47 has a vertical height that depends on the height of the brick ledge. If there is no brick ledge, the sheathing height is the full height of the wall.

Figure 5:
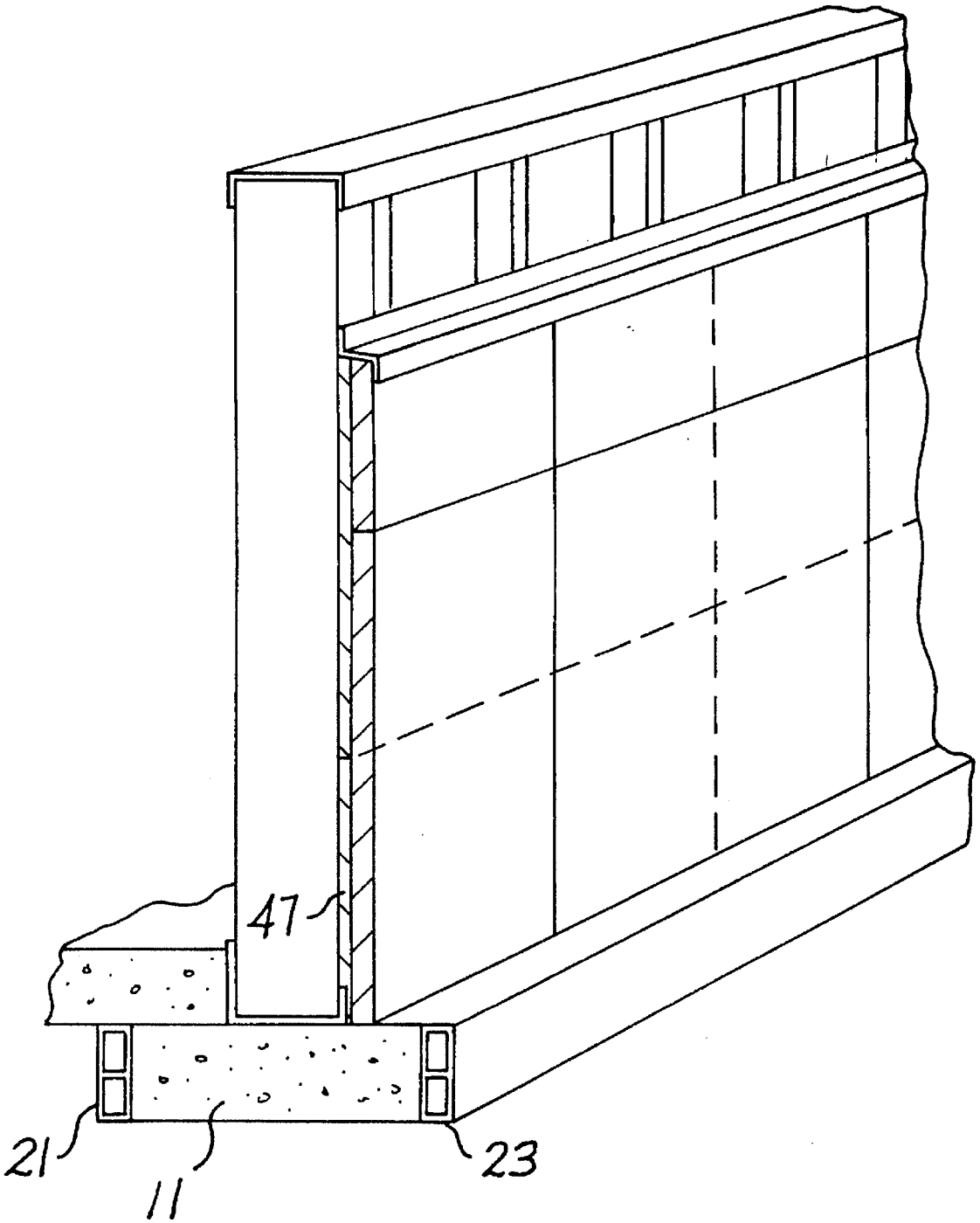
FIG. 5 is a fragmentary perspective view of the outside of the sheathing.

The sheathing has a preferred width dimension of about 4' (normal to the plane of the paper in FIG. 1). The width of each panel 47 is a multiple of the centerline spacings of studs 15, such that each panel 47 has vertical edge areas overlapping the outer faces of selected studs, as shown in FIGS. 3 and 5.

FIG. 3 shows edge areas of two representative panels 47 facially engaged with the outer face of metal stud 15. The panel edges abut against each other to form a vertical seam, designated generally by numeral 50. Each panel 47 is adhesively fastened to the associated metal stud to hold the panels until the wall is back filled. Then the earth holds the panels against the studs. Mechanical fasteners are avoided to prevent leaks.

Each inner panel 47 is preferably formed of a closed cell rigid foam core material, and two facing sheets 55 of thermally reflective aluminum foils. Panel 47 is commercially available from the Celotex Corporation under the trademark "Thermax".

Each panel 47 is attached to the associated studs 15 by conventional adhesives sprayed or otherwise applied to the outer edge surfaces of the metal studs.

Typically, each inner panel 47 is attached to five metal studs (or posts) 15, i.e. two studs 15 at the edges of the panel (FIG. 3), plus three studs spaced along the panel major face. Panels 47 have their edges abutted together to form a continuous inner panel layer around the entire perimeter of the basement.

Outer panels 49 are installed after the inner panels 47 have been mounted on the supporting metal studs 15. Each outer panel 49 has the same foam core material as panel 47, i.e. a rigid closed cell foam material having good thermal insulation properties. The surfaces of the rigid foam core are covered with a thin glass fiber film or sheet, that gives the panel a toughness and puncture resistance not possible with the core material alone. Each outer panel 49 is preferably commercially available from the Celotex Celotex Corporation under the trademark "Quik-R".

Outer panels 49 are laminated to inner panels 47, using adhesives that are sprayed, rolled or brushed onto the mating panel surfaces. Since the surface areas of panels 47 and 49 are relatively large, the adhesive attachments are sufficient for affixing panels 49 to panels 47. Mechanical attaching devices are avoided to prevent water leaks.

Panels 49 are installed so that vertical edges on adjacent panels abut together to form a vertical seam, similar to seam 50 formed between the abutting vertical edges of inner panels 47. FIG. 3 shows two outer panels 49 having vertical edges abutted together along the dashed lines to form a vertical seam 57. The abutting panel 49 edges are precoated with a thin film of elastomeric adhesive sealant, whereby the seam 57 is sealed against penetration of ground water into or through the panel assembly. Vertical seams 50 formed by the abutting edges of panels 47 are similarly sealed.

As shown in FIG. 3, vertical seams 57 are offset horizontally from seams 50, such that a labyrinth deters migration of ground water through the panel assembly. The adhesive joints between the mating major faces on panels 47 and 49 act as panel-joining mechanisms and also as face seals to augment the sealing action of the sealant materials.

Each inner panel 47 is thinner than each outer panel 49. The relatively light panels 47 can be adhesively supported on studs 15, even though the total stud surface areas may be relatively small in comparison to the panel surface area. The thickness of panels 47 may be about 1½", whereas the corresponding thickness of panels 49 may be about 2". The combination of the two panels provides a relatively high thermal insulation value, e.g. an R value of about 25.

The upper ends of studs 15 are joined to an upper elongated channel-shaped, galvanized metal track or cap 59 that extends along and around the perimeter of the basement. Cap 59 is attached to the vertical studs by self-tapping screws 60.

FIG. 7 illustrates a typical corner steel frame construction.

The edges of both the inner and outer horizontal and vertical panel seams are staggered to provide a labyrinth water path at the panel edges. An elastomeric sealant is applied to all abutting panel edges to provide a labyrinth seal.

During service, the rigid foam sheathing 17 (comprising panels 47 and 49) provides a continuous barrier preventing ground water from flowing into the basement interior space. Lower sill 31 is sealed to the upper surface of footing 11 such that ground water is directed into drain tiles 21 and 23.

Water accumulating in sill 31 drains into drain tile 21 through small flexible plastic tubes 69. In an actual installation, plastic tubes 69 are located at several points along each basement wall, e.g. spaced apart about 3'.

A horizontal brick ledge 70 formed of a 16 gage, galvanized metal is attached by self-tapping screws (not shown) to the studs directly above the sheathing as illustrated in FIG. 1.

The principal advantages of the illustrated wall construction are its high thermal insulation value, and its relatively good leakage resistance. The use of metal studs is advantageous because the metal resists rotting, while providing a relatively good vertical load-carrying capability. The use of two panels 47 and 49 for the sheathing strengthens the sheathing against horizontal buckling or deformation, since the adhesive connections between the faces of panels 47 and 49 strengthens the panel assembly. The horizontal offsetting of seams 50 and 57 prevents water leakage and buckling.

Having described my invention, I claim:

1. A basement construction, comprising:

an underground concrete footing (11) having an upper face;

a concrete floor (19) having an outer edge area overlying the upper face of said footing;

a channel-shaped cross-section sill (31) extending along said footing;

said sill comprising a web (33) resting on the footing upper face, an upstanding inner flange bordering said concrete floor, and an upstanding outer flange spaced from said inner flange, to form a water collection mechanism;

a plurality of vertical metal studs (15) extending upwardly from said sill at spaced points therealong;

each of said metal studs having a lower end portion fitting snugly within the sill in facial contact with both of said sill flanges;

means (39) affixing each metal stud to said sill;

each of said metal studs having an outer flat face generally coplanar with the outer flange of said sill to form an outwardly-facing panel mounting surface;

a plurality of rigid thermal-insulating sheathing panels secured flatwise on each of said mounting surfaces;

said sheathing panels having vertical side edges abutted together to form vertical seams;

said panels forming a continuous underground basement wall reinforced against earth pressures by the metal studs;

said sill inner flange having an upper edge spaced above the plane of the concrete floor to act as a dam to oppose water flow from the sill onto the concrete floor;

the upper edge of said sill outer flange being spaced below the upper edge of the sill inner flange;

said concrete footing having an inner edge and an outer edge;

a series of connected inner drain tiles (21) extending along the inner edge of said footing;

a series of connected outer drain tiles (23) extending along the outer edge of said footing;

a number of bleeder tubes (27) connecting said inner drain tiles to said outer drain tiles at spaced points therealong; and a plurality of water drainage conduits (69) extending between said inner flange of said sill and said inner drain tiles at spaced points therealong to pass water from the sill to the inner drain tiles.

2. The basement construction of claim 1, wherein each of said studs comprises a hollow post having a C-shaped cross section that includes a web wall oriented normal to the plane of the sheathing panels.

3. The basement construction of claim 1, wherein the spacing between the metal studs is substantially less than the corresponding width dimension of each sheathing panel, whereby each panel is reinforced by a plurality of metal studs.

4. The basement construction of claim 1, including a horizontal brick ledge mounted on the upper ends of the vertical metal studs.

5. A basement construction, comprising:

an underground concrete footing (11) having an upper face, an inner edge and an outer edge;

a concrete floor (19) having an outer edge area overlying the upper face of said footing;

a channel-shaped cross-section sill (31) extending along said footing;

said sill comprising a web (33) resting on the footing upper face, an upstanding inner flange bordering said concrete floor, and an upstanding outer flange spaced from said inner flange, to form a water collection mechanism;

a wall extending upwardly from said sill;

a series of connected inner drain tiles (21) extending along the inner edge of said footing;

a series of connected outer drain tiles (23) extending along the outer edge of said footing;

a number of bleeder tubes (27) connecting said inner drain tiles to said outer drain tiles at spaced points therealong;

a plurality of water drainage conduits (69) extending between said sill and said inner drain tiles at spaced points therealong to pass water from the sill to the inner drain tables;

said sill inner flange having an upper edge spaced above the plane of the concrete floor to act as a dam to oppose water flow from the sill onto the concrete floor; and the upper edge of said sill outer flange being spaced below the upper edge of the sill inner flange.

* * * * *